United States Patent [19]

Mott

[11] 3,941,348

[45] Mar. 2, 1976

[54] SAFETY VALVE

[75] Inventor: James D. Mott, Houston, Tex.

[73] Assignee: Hydril Company, Houston, Tex.

[22] Filed: May 7, 1974

[21] Appl. No.: 467,657

Related U.S. Application Data

[63] Continuation of Ser. No. 267,509, June 29, 1972, abandoned.

[52] U.S. Cl. ..... 251/58; 166/224 A

[51] Int. Cl.[2] F16K 31/143; E21B 33/00; F16L 5/00

[58] Field of Search ..... 251/58; 166/224

[56] References Cited

UNITED STATES PATENTS

| | | | |
|---|---|---|---|
| 3,035,808 | 5/1962 | Knox | 251/58 |
| 3,064,937 | 11/1962 | Pryor | 251/315 X |
| 3,167,300 | 1/1965 | Kaiser | 251/315 |
| 3,473,554 | 10/1969 | King | 251/315 X |
| 3,750,749 | 8/1973 | Giroux | 166/224 R |
| 3,762,471 | 10/1973 | Mott | 166/224 A |
| 3,806,082 | 4/1974 | Kellner | 251/58 |

*Primary Examiner*—Henry T. Klinksiek
*Attorney, Agent, or Firm*—Pravel & Wilson

[57] ABSTRACT

A remotely operable safety valve mounted between the swivel and the kelly in drilling operation including a spherically-shaped valve element which is mounted in a generally tubular housing rotatable with the swivel sub, the kelly and the drill string. Hydraulic means move the valve element between open and closed positions in order to control flow through the drill-string and prevent in-line blow outs. As an additional safety feature, spring means move the valve element to a closed position in the event of a failure of the hydraulic means.

1 Claim, 6 Drawing Figures

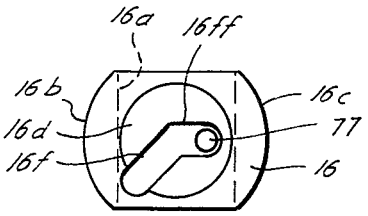
Fig. 5
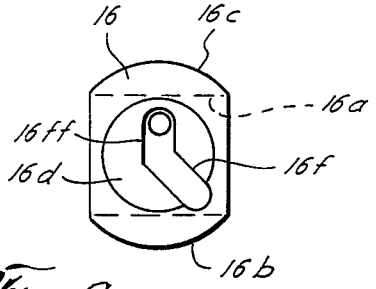
Fig. 6
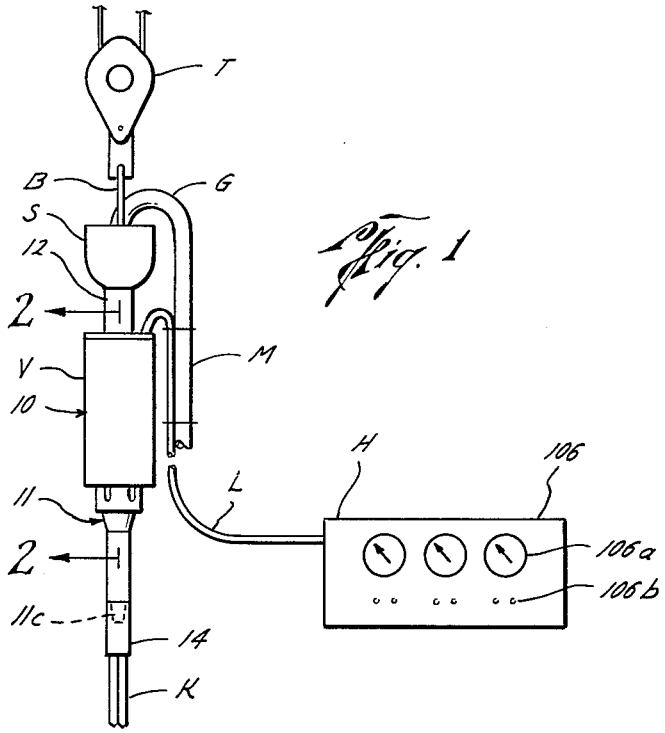
Fig. 1
Fig. 4
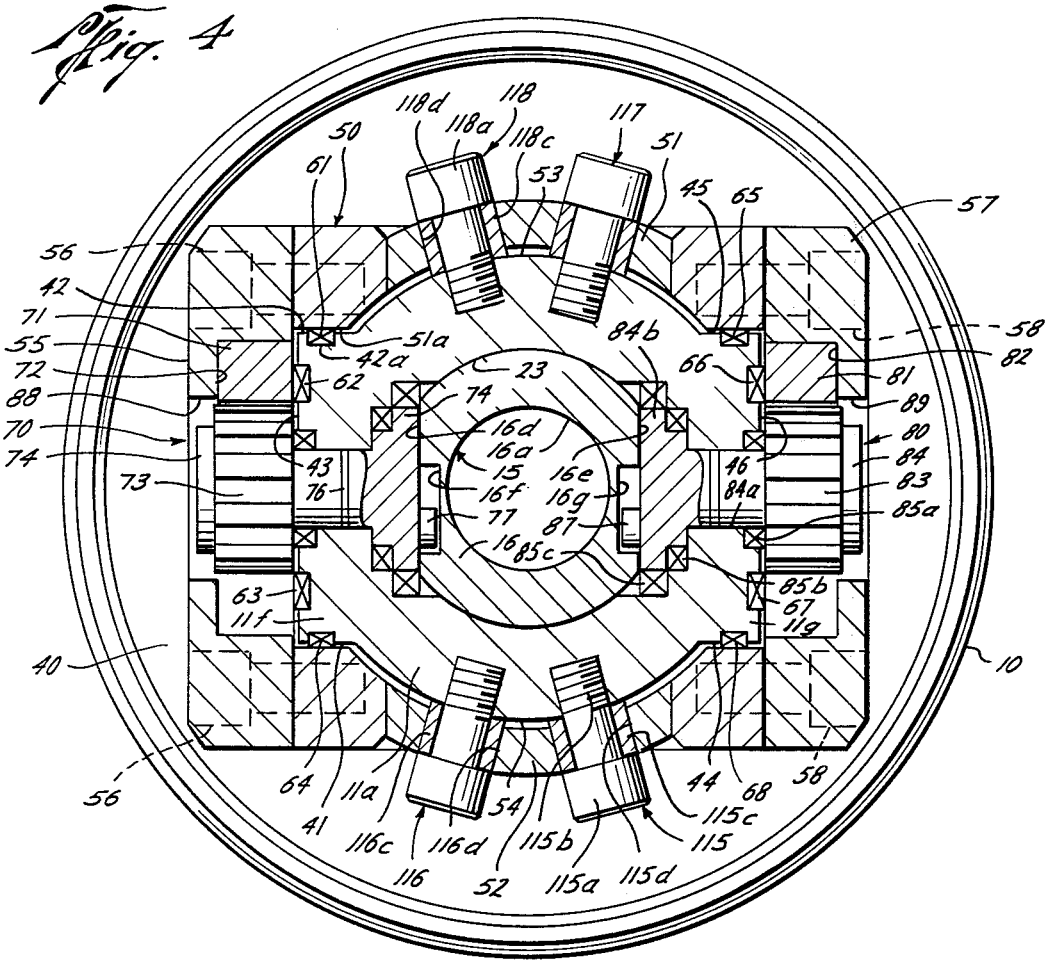

SAFETY VALVE

This is a continuation, of application Ser. No. 267,509 filed June 29, 1972, now abandoned.

BACKGROUND OF THE INVENTION

1. Field of the Invention

The field of this invention is valves, and in one aspect, safety valves for regulating flow through rotatable tubular members.

2. Description of the Prior Art

A problem in drilling wells, particularly in emergency situations, is providing safety valves which can block off flow from the well through the rotatable drilling string, kelly and swivel.

Under normal oil well drilling conditions, drilling mud is pumped from the mud pumps at the platform, through the rotating swivel, the rotating kelly, and the rotating drilling string, in order to sweep or wash away cuttings from the drilling bit and return same to the well bore surface in a manner well known. In the event of a sudden increase in downhole pressure, such as from a kick, or when a blowout threatens, flow upwardly through the drilling string and kelly from downhole must be blocked in order to maintain control of the well and prevent drilling mud loss.

Often, valves are mounted above and below the kelly in order to shut off flow through the kelly and the drilling string. However, such valves, sometimes referred to as "kelly cocks", have in the past been ball valves that must be manually rotated to a closed position by a special or other type tool.

Occasionally, it is necessary to close off flow through the kelly under emergency conditions such as, for example, upon the occurrence of an offshore platform fire. In such an emergency situation, it may be impossible for an operator to get close enough to the kelly cock to close the valve and thus the well continues to flow until it can be shut in by other means which can be costly relative to the ecology of the area and costly economically. In addition, under blowout or downhole increased pressure conditions it may be impossible to close the kelly cock because of gases, danger of fire or other causes.

SUMMARY OF THE INVENTION

A remotely operable in line safety valve is mounted below the swivel in order to shut off flow through the kelly and thus through the drilling string. The in line safety valve includes a stationary housing and a rotating housing which is attached to the swivel sub or kelly spinner sub and to the kelly such that the rotating housing rotates with the kelly. Under normal conditions, mud is pumped through the swivel, a bore in the rotating housing, and through the kelly into the drilling string.

An actuating sleeve is mounted concentrically outwardly of the rotating housing for slidable movement with respect thereto. Gear means operably connect the actuating sleeve and a spherically shaped valve element mounted in the bore of the rotating housing such that movement of the actuating sleeve causes the valve element to open and close the bore in the rotating housing. Hydraulic power means are used to move the actuating sleeve and thus actuate the gear means and rotate the valve element. The use of the hydraulic power means to operate the valve allows operation from a remote location, even while the kelly is rotating.

Resilient means are positioned between the stationary housing and the actuating sleeve to urge the actuating sleeve to move the valve element to a closed position whereby the resilient means closes the valve in the event of failure of the hydraulic power means.

Another feature of this invention, is that the valve element is mounted in the bore of the rotating housing for longitudinal movement or floating in the closed position thereby providing two effective sealing zones so that one zone may be operable to block off flow through the bore in the event of a failure of the other zone. In this manner, flow through the kelly and drilling string can be safely controlled in the event of an emergency or incipient condition such as a kick or threatened blowout even though it is physically impossible to approach the kelly due to a fire or other platform danger or damage.

BRIEF DESCRIPTION OF THE DRAWINGS

The preferred embodiment of this invention will be described hereinafter, together with other features thereof, and additional objects will become evident from such description.

The invention will be more readily understood from a reading of the following specification and by reference to the accompanying drawings forming a part thereof wherein an example of the invention is shown and wherein:

FIG. 1 is a schematic view illustrating the safety valve of a preferred embodiment of this invention mounted at the upper kelly in an oil or gas well;

FIG. 4 is a sectional view taken along line 4—4 of FIG. 2 further illustrating the valve element and gear means of this invention with the safety valve in an open position;

FIG. 5 is a detailed view of the position of the valve element of this invention in the open position; and FIG. 6 is a detailed view of the position of the valve element of this invention in the closed position.

DESCRIPTION OF THE PREFERRED EMBODIMENT

With reference to FIG. 1, the letter V generally designates an in line safety valve of this invention mounted for operation and use below a swivel S of an oil or gas well. The swivel S is suspended from a travelling block T which is attached to bail B of the swivel in a manner typical of well drilling operations. The safety valve V is mounted below the swivel S and above kelly K whereby a portion of the valve V rotates with the kelly K and the drilling string (not shown) during normal drilling operations. During such normal drilling operations, drilling mud is pumped through a mud line M, through the goose neck G attached thereto, through the swivel S, the safety valve V of this invention, through the kelly K and into the drilling string (not shown) which is attached to the kelly K such that cuttings of the drill bit are continually washed away in a manner well known to those possessing skills in the drilling field.

The valve V is actuated by a hydraulic means generally designated as H which is illustrated in FIG. 1 as being located at a point remote from the valve V, but is connected thereto by hydraulic line L, such that the valve V may be actuated to regulate flow through the swivel S, the kelly K, and the drilling string by providing hydraulic fluid under pressure to the valve V in a manner which will be described in greater detail hereinafter. It should be understood that the valve V of this invention may also be mounted below a Kelly Spinner which is, of course, mounted below the swivel S when utilized.

Figure 2:
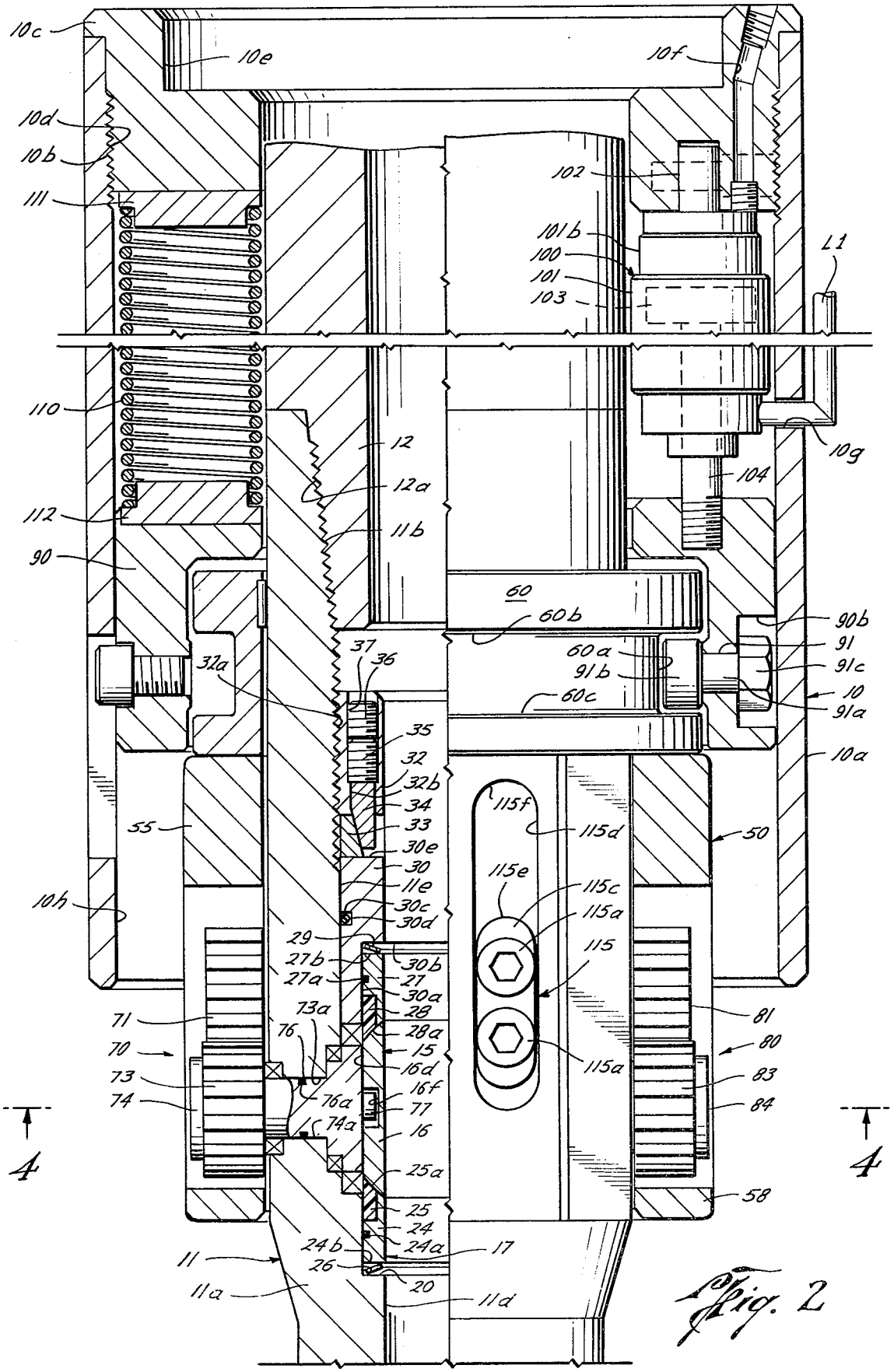
FIG. 2 is an enlarged view partially in section and partially in elevation taken along line 2—2 of FIG. 1 illustrating the safety valve in an open position.
Figure 3:
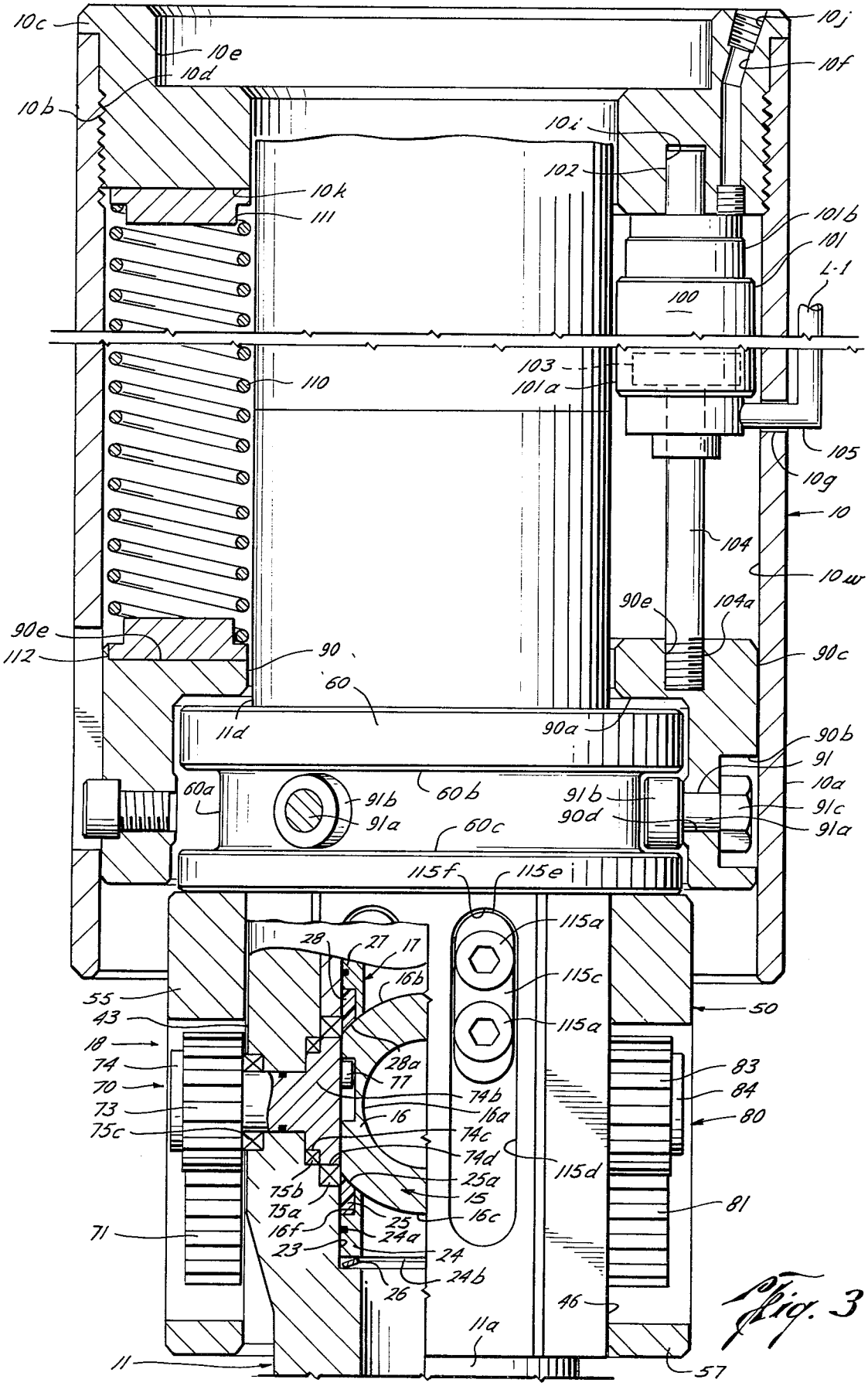
FIG. 3 is a view partially in section and in elevation similar to FIG. 2, illustrating the safety valve in a closed position.

Referring to FIGS. 2 – 4, the valve V basically includes a stationary housing generally designated as 10. The stationary housing 10 is a generally tubular assembly which includes a main cylindrical housing portion 10*a* that has female threads 10*b* which threadedly mount an adapter 10*c* having male threads 10*d*. The adapter 10*c* includes an upper recess 10*e* which is adapted to receive any other stationary member such as a portion of the swivel S. The adapter 10*c* further includes a passageway 10*f* and the main cylindrical housing portion 10*a* includes an aperture 10*g* for receiving hoses such as L1 of the hydraulic Line L.

The valve further includes a rotating housing section or tubular assembly generally designated as 11. The rotating housing section 11 includes a main body section 11*a* having female threads 11*b* which threadedly mount an adapter or sub 12 having male threads 12*a*. Referring to FIG. 1, in the preferred embodiment of this invention, the sub 12 is actually the lower rotating sub of the swivel S; however, it should be understood that the sub 12 may also be the lower sub of a Kelly Spinner. The main body portion 11*a* is threadedly connected at its lower end 11*c* to an upper kelly adapter 14. In this manner, the rotating housing section 11 is mounted for rotation with both the rotating portion of the swivel S and the kelly K. A bore 11*d* extends through the rotating body portion 11*a* whereby fluid, such as drilling mud, is free to flow through the mud lines M, the goose-neck G, the swivel S and the bore 11*d* in the main body section 11*a* into the kelly and into the drilling string (not shown).

In order to close off flow through the bore 11*d*, a bore closure means generally designated 15 includes a partially spherical valve element 16 having an opening 16*a* therethrough. The valve element 16 is mounted for rotation with respect to the body section 11*a* by a seat means generally designated by the number 17. An actuating means generally designated by the number 18 is disposed concentrically outwardly of the rotating housing section 11 and is operably connected to the stationary housing section 10 and to the bore closure means 15 for moving the valve element 16 between a closed position, which is illustrated in FIG. 3, in which flow through the bore 11*d* of the main cylindrical rotating housing portion 11*a* is blocked, and an open position in which the opening 16*a* of the valve element 16 is substantially aligned with the bore 11*d* to allow the passage of fluid through the kelly and into the drilling string (not shown).

As mentioned previously the valve element 16 is partially spherical. Referring to FIGS. 3 and 6 (where the valve element is in open position), the valve element 16 includes an upper outer surface 16*b* and a lower outer surface 16*c* which are spherical segments. The valve element 16 further includes flat side portions 16*d* and 16*e*. A slot 16*f* is cut through side 16*d* of the valve element 16 and a slot 16*g* is cut through side 16*e*. The slots 16*f* and 16*g* are utilized in cooperation with the actuating means generally designated as 18 (in a member to be described in greater detail hereinafter) to rotate the valve element 16 between the open and closed position within the bore 11*d*.

The valve element 16 is mounted for rotation with respect to the main rotating body section 11*a* in the following manner. A lower shoulder 20 is machined in the bore 11*d* in order to provide a seating recess 23, which, as illustrated in FIG. 4, is basically circular in cross-section. A lower circular seat ring 24 is mounted for slidable movement within the recess 23 in the bore 11*d* and a sealing ring 24*a* mounts the lower seat ring 24 for sealable movement in addition to the slidable movement. A concave, circular sealing ring or element 25 is mounted onto the lower seating ring 24 to provide a concave upper sealing surface 25*a* which is adapted to sealably conform to the lower outer partially spherical surface 16*c* of the valve element 16 in the closed position of FIG. 3. Resilient means in the form of a wavy spring 26 is mounted onto the lower shoulder 20 of the recess 23 and is circular in shape to conform to the lower end 24*b* of the lower seat ring 24 to continually urge the lower seat ring 24 and the sealing ring 25 mounted therein into sealable engagement with the lower outer partially spherical surface 16*c* of the valve element 16. As will be described in greater detail hereinafter, the valve element 16 is actually mounted for slidable longitudinal movement within the recess 23 when the valve element 16 is in the closed position of FIG. 3. In such closed position, the lower seating ring 24, due to the resilient urging of the wavy spring 26, moves upwardly as well as downwardly with the valve element 16 in order to continually provide a lower sealing zone between the sealing ring 25 and the lower outer partially spherical surface 16*c* of the valve element 16. The concavity of the surface 25*a* of the sealing ring 25 also serves to mount the valve element 16 for rotation with respect to the main rotating body section portion 11*a*.

A circular mounting collar 30 is positioned against the inside wall 11*e* of the rotating main body section 11*a* and includes an offset portion 30*a* which is formed by the shoulder 30*b*. The offset portion 30*a* has an inner diameter substantially that of the circular portion of the recess 23 below the valve element 16. The mounted collar 30 is secured with respect to the inside wall 11*e* of the rotating body section 11*a* in a manner to be described hereinafter. A seal ring 30*c* is mounted in a groove 30*d* in the mounting collar 30.

An upper seat ring 27 generally circular in shape is mounted for slidable movement within the offset portion 30*a* of the collar 30. A seal ring 27*a* is positioned between the seat ring 27 and the offset portion 30*a* to prevent the passage of fluid therebetween so that the seat ring 27 is mounted for both slidable and sealable movement with respect to the mounting collar 30. A seal ring 28 is mounted on the seat ring 27 and includes a concave lower sealing surface 28*a* which conforms to the upper partially spherical outer surface 16*b* of the valve element 16. A resilient means in the form of a wavy spring 29 extends between the shoulder 30*b* and the upper end 27*b* of the upper seat ring 27 in order to continually urge the seal ring 28 into sealable engagement with the upper partially spherical outer surface 16*b* of the valve element 16. In this manner, the upper seat ring 27 and the seal ring 28 mounted therein cooperate with the partially spherical outer surface 16*b* of the valve element 16 to provide an upper sealing zone to prevent the passage of fluid through the bore 11*d* of the main rotating body section 11*a*.

The mounting collar 30 is secured by a threadedly mounted setting sleeve 32 which has threads 32*a* at its outer surface in order to threadedly mount with the female threads 11*b* of the main rotating body section 11*a*. A lower circular wedge element 33 is placed against the upper surface 30*e* of the mounting collar 30 and the setting member or sleeve 32 is then threadedly mounted to a position slightly above the circular wedge element 33. An upper complementing circular wedge element 34 extends downwardly from a slot 32*b* in the setting sleeve 32 and is wedged against the lower circular wedge element 33 in order to secure the mounting collar 30 in position. Upper and lower set screws 35 and 36 are mounted in threaded holes such as 37 in the setting sleeve 32 at various points about the setting sleeve 32 in order to lock the upper circular wedge element 34 against the lower circular wedge element 33. In this manner, the valve element 16 is mounted in the bore 11*d* in the main rotating body section 11*a* for rotation with respect thereto.

The actuating means 18 of this invention includes an actuating sleeve assembly generally designated as 50 which is positioned concentrically outwardly of the main rotating body section 11*a* and is mounted for rotation with and for slidable, longitudinal movement with respect to the section 11*a*. The rotating body section 11*a* includes side portions 11*f* and 11*g*. The side portion 11*f* includes vertically extending flat faces 41 and 42 which are joined by a vertically extending flat face 43. In a similar manner, flat faces 44 and 45 are joined by a vertically extending flat face 46. The surfaces 42 and 45 of the rotating body section 11*a* are joined by a convex outer surface 53 and the surfaces 41 and 44 are joined by a convex outer surface 54.

The actuating sleeve assembly comprises opposing partially cylindrical segments 51 and 52 which basically conform to cylindrical outer surfaces 53 and 54, respectively, of the rotating body section 11*a*. A side housing portion 55 is attached by means of bolts 56, which are illustrated in broken lines in FIG. 4, to the cylindrical segments 51 and 52. A similar side segment 57 is mounted onto the cylindrical segment 51 and 52 by means of bolts 58 which are also shown in broken lines in FIG. 4. In this manner, the cylindrical segments 51 and 52 cooperate with the side housing segments 55 and 57 to form the actuating sleeve 50 which is mounted for slidable movement longitudinally with respect to the outer surfaces such as 53, 54, 43 and 46 of the rotating body section 11*a*.

An upper actuating sleeve 60 includes an outer circular recess 60*a* and is also disposed concentrically outwardly with respect to the rotating body section 11*a*. The upper actuator sleeve 60 is attached to actuator sleeve 50 by any suitable means such as welding or bolts (not shown) such that the actuator sleeves 60 and 50 are both mounted for slidable movement with respect to the rotating body section 11*a* and for rotation with the section 11*a*.

In order to prevent the passage of fluid between the rotating body section 11*a* and the actuating sleeve assembly 50, a plurality of seals are provided. The seals such as seal 61 are mounted in a vertically extending groove 42*a* in face 42 of the extending side portion 11*f* of the rotating section 11*a*. The seal 61 extends into sealable engagement with opposing face 51*a* of the partially cylindrical segment 51 of the outer sleeve assembly 50. In a similar manner longitudinal or vertically disposed seals 62, 63, 64, 65, 66, 67 and 68 provide vertically extending sealing areas between the rotating body section 11*a* and the actuator sleeve assembly 50.

The actuating means 18 further includes a gear means generally designated at 70 which is mounted in the side housing portion 55 of the actuator sleeve assembly 50 and is operably connected to the valve element 16 in order to rotate the valve element between the open and closed position in response to slidable, longitudinal movement of the actuator sleeve assembly 50. Another gear means generally designated as 80 is mounted in the side housing portion 57 of the actuator sleeve assembly 50 in order to cooperate with gear means 70 to rotate the valve element.

The gear means 70 includes a rack 71 which is mounted in a recess 72 in the housing side portion 55 and extends vertically therein. A pinion 73 is fixedly mounted on a shaft 74 by any suitable means, such as a key (not shown). The shaft 74 is mounted for rotation in an opening 74*a* in the rotating body section 11*a*. The shaft 74 includes a collar portion 74*b* which is provided with stepped shoulders 74*c* and 74*d*. Bearings 75*a*, 75*b* and 75*c* mount the shaft 74 for rotation within the opening 74*a* in the body section 11*a* and an O-ring seal 76 is mounted in a groove 76*a* in the shaft 74 to prevent the passage of fluid between the shaft and the outer wall of the opening 74*a*.

Finally a pin 77 is eccentrically mounted for rotation with the shaft 74. The pin 77 may be attached eccentrically or off-center with respect to the axis of rotation of the shaft 74 by any suitable means such as welding or bolts or the pin 77 may be even integral with the shaft 74. The pin 77 extends into the slot 16*f* in the face 16*d* of the valve element 16 whereby the pin 77 engages the walls of the slot 16*f* to rotate the valve 16 as the shaft 74 is rotated.

A gear means 80 is mounted within the side housing portion 57 in a manner similar to the gear means 70. The gear means 80 includes a rack 81 mounted in a recess 82 in the side housing portion 57 such that the rack extends vertically. A pinion 83 is fixedly mounted by any suitable means such as a key (not shown) to a shaft 84. The shaft 84 is mounted for rotation in an opening 84*a* in the rotating housing section 11*a* and includes an enlarged portion 84*b*. The shaft 84 including the enlarged portion, 84*b*, is mounted for rotation by means of bearings 85*a*, 85*b* and 85*c*. A pin 87 is eccentrically mounted onto the enlarged portion 84*a* of the shaft 84 and extends inwardly into the slot 16*g* in the flat side face 16*e* of the valve element 16.

As the actuator sleeve assembly 50 is moved downwardly, the racks 71 and 81 move downwardly and cause the pinions 73 and 83 to rotate the shafts 74 and 84. Rotation of the shaft 74 causes pin 77 to engage a wall of the slot 16*f* and rotate the valve element 16 to the closed position illustrated in FIG. 3. Similarly, the pin 87 rotates with shaft 84 and engages a side of the slot 16*g* in the valve element 16 to cooperate with shaft 74 to cause the valve element to rotate. For the purposes of assembly, it may be mentioned that side housing portion 55 includes an opening 88 which allows the assembly of the rack 71, pinion 73 and shaft 74 combination. In a similar manner, the side housing portion 57 is provided with an opening 89 which allows the assembly of the rack 81, the pinion 83 and the shaft 84.

The movement of the upper support sleeve 60 in conjunction with the actuating sleeve assembly 50 has been previously described as including rotation with the rotating body section 11*a*. This rotation is partially due to the rack and pinion connections provided by the gear means 70 and 80. The upper support sleeve 60 and the actuating sleeve assembly 50 are also mounted for slidable, longitudinal movement with respect to the rotating body section 11*a*. In order to move the upper support sleeve 60 and the actuating sleeve assembly 50 longitudinally, a supporting collar 90 is mounted for slidable movement with respect to the inside wall 10*h* of the main cylindrical housing portion 10*a*. The support collar 90 includes a downwardly facing circular shoulder portion 90*a* which is adapted to fit about the upper support sleeve 60. The upper support sleeve 60 is mounted for rotation with respect to the support collar ring 90 by means of a plurality of bearings 91. Each bearing 91 is mounted in a recess 90*b* in the outside wall 90*c* in the support collar 90. Each bearing 91 includes a shaft portion 91*a* which extends through an opening 90*d* radially directed through each recess 90*b* in the support collar 90. A bearing roller 91*b* is mounted for rotation with respect to the shaft 91*a* of the bearing 91 and the shaft 91*a* and bearing roller 91*b* are secured in the opening 90*b* in the support collar 90 by the bolt 91*c*. Each bearing roller 91*b* extends into the recess 60*a* in the upper support sleeve 60 and engages either upper wall 60*b* or lower wall 60*c* such that the upper support sleeve 60 and the actuating sleeve assembly 50 attached thereto are rotatable with respect to the main cylindrical housing portion 10*a* even as the upper support sleeve 60 and actuating sleeve assembly 50 are moved longitudinally upwardly and downwardly with respect to the rotating main body section 11*a*.

The valve element 16 is moved between open and closed positions with respect to the bore 11*d* by the operation of a plurality of double-acting hydraulic cylinders such as the hydraulic cylinder generally designated as 100. The hydraulic cylinder 100 basically comprises a hydraulic cylinder 101 having an upper threaded shaft portion 102 that is threadedly engaged in a threaded hole 10*i* in the adapter 10*c*. A piston 103 is slidably, sealably mounted within the hydraulic cylinder housing 101 in a manner well known and, a rod 104, is attached to the piston 103 in any suitable manner. The rod 104 includes a threaded end portion 104*a* which is threadedly mounted in a threaded hole 90*e* in the support collar 90. The passageway 10*f* extending through the top of the adapter 10*c* and the passageway 10*f* has a threaded end portion 10*j* which is adapted to receive a coupling (not shown) which is connected to a hose (not shown) in the hydraulic line L, such that hydraulic fluid water pressure can be supplied to the upper chamber portion 101*b* of the cylinder 101. The hydraulic cylinder 100 is double-acting; therefore, another hydraulic hose L1, which is a part of the hydraulic line L, is mounted into lower chamber portion 101*a* of the hydraulic cylinder 101 by means of a coupling 105 which extends through an opening 10*g* in the main cylinder housing portion 10*a*.

Thus whenever hydraulic fluid is applied under pressure through the passageway 10*f*, the hydraulic fluid under pressure enters the upper chamber portion 101*b* of the hydraulic cylinder 101 and displaces the piston 103 and the rod 104 downwardly. Conversely, whenever hydraulic fluid under pressure enters the hydraulic hose L1 and the lower chamber portion 101*a* of the hydraulic cylinder housing 101, the piston 103 and rod 104 are moved upwardly. The hydraulic fluid is applied to the double acting cylinder 100 as well as the other double acting cylinders (not shown) by the remotely located hydraulic means H. The remotely located hydraulic means H is illustrated schematically in FIG. 1 where a panel 106 having dials such as 106*a* is shown. The panel 106 includes conventional controls, which are represented schematically by the knobs 106*b*, that control the application of hydraulic fluid through the hydraulic line L into the hydraulic hose L1 or the hydraulic hose that is mounted at the threaded portion 10*j* of the passageway 10*f*.

Therefore, the plurality of hydraulic cylinders such as the double-acting hydraulic cylinder 100 are mounted between the stationary adapter 10*c* and the support collar 90 which is mounted for slidable movement with respect to the inside wall 10*h* of the stationary housing portion 10*a*. By operating the controls on the panel 106*b* represented by the knob 106*b*, hydraulic fluid under pressure may be applied through the hydraulic line L into either the lower chamber portion 101*a* of the hydraulic cylinder 101, the passageway 10*f* of the adapter 10*c* and into the upper chamber portion 101*b* of the hydraulic cylinder 101.

The valve element 16 is actually moved to the closed position by moving the actuating sleeve assembly 50 and the upper support sleeve 60 downwardly to the position of FIG. 3. In order to insure that the valve element 16 will block off or close the bore 10*d* in the event of some emergency condition such as damage to the remotely located hydraulic means H, a plurality of coiled springs 110 are positioned in compression between the mounting element 111, which is attached to a lower surface 10*k* of the adapter 10*c*, and a mounting element 112, which is attached to the upper surface 90*e* of the support collar ring 90. It is understood that the mounting elements 111 and 112 may be attached to the adapter 10*c* and the support collar ring 90, respectively, by any suitable means such as welding or a threaded means such as bolts (not shown). The compressed coil springs such as the coil spring 110 urge the support collar 90 and thus the support ring 60 and the actuating sleeve assembly 50 attached thereto downwardly, so that, in the event of a failure of the plurality of double acting hydraulic cylinders such as 100, the valve element 16 is rotated to the closed position.

In order to limit upward and downward movement of the upper support sleeve 60 and the actuator sleeve assembly 50, a plurality of limit means as 115, 116, 117 and 118 are mounted with the main body rotating section 11*a* and extend outwardly therefrom into slots in the partially cylindrical segments 51 and 52 of the actuating sleeve assembly 50. The limit means 115, which is illustrated in FIGS. 2, 3 and 4, includes two bolts 115*a* which extend into threaded holes such as 115*b* in the cylindrical outer surface 54 of the body section 11*a* and mount a disk element 115*c*. The disk element 115*c* is of sufficient thickness to extend into an elongated slot 115*d* in the partially cylindrical segment 52 of the actuating sleeve assembly 50.

The limit means 115 actually limits the movement of the actuating sleeve assembly 50 downwardly. When the actuating sleeve assembly 50 and thus the partially cylindrical segment 52 thereof is moved downwardly, the upper rounded end 115*e* of the disk element 115*c* is engaged by the upper rounded end 115*f* of the elongated slot 115*d* thereby stopping downward movement of the actuating sleeve assembly 50.

In a similar manner the limit means 118 includes a disk element 118*c* which is secured to the cylindrical surface 53 of the rotating body section 11*a* by means of bolts such as 118*a*. The disk element 118*c* extends into a slot 118*d* in the partially cylindrical segment 51 of the actuating sleeve assembly 50 and is positioned to engage the upper end of the slot 118*d* as the actuating sleeve assembly 51 is moved downwardly. The limit means 118 and 115 cooperate to limit the downward movement of the actuating sleeve assembly 50.

In a similar manner the limit means 116 includes a disk element 116*c* mounted onto the cylindrical outer surface 54 of the rotating housing portion 11*a* and extends into a slot 116*d* in the partially cylindrical segment 52 of the actuating sleeve assembly 50 to limit upward movement of the actuating sleeve assembly. The limit means 117 is mounted in the cylindrical outer surface 53 of the rotating body section 11*a* and cooperates with the limit means 116 to limit the upward movement of the actuating sleeve assembly 50.

OPERATION

The safety valve V of the preferred embodiment of this invention is operated or used in the following manner. During normal drilling conditions in an oil or gas well, a drilling mud is pumped through the goose neck G, the swivel S, the bore 11*d* in the rotating body section 11*a* of the valve V of this invention, trhough the kelly K and into the drilling string (not shown) in order to wash away drilling cuttings downhole. Whenever it is desired to close the valve V, such as when a kick or a blowout threatens, the valve V of this invention can be closed from a remote location in the following manner.

An operator, utilizing the panel 106, operates the remotely located hydraulic means H in order to apply hydraulic fluid under pressure through the hydraulic line L and the hydraulic hose (not shown) connected with the passageway 10*f* in the adapter 10*c*. Hydraulic fluid under pressure thus enters the upper chamber portion 101*a* of the hydraulic cylinder 101 and causes the piston 103 and rod 104 attached thereto to move downwardly, which moves downwardly the support collar 90. The upper support sleeve 60 and the actuating sleeve assembly 50 attached thereto will be rotating if the rotating body section 11*a* and the kelly K are rotating. The valve V of this invention will operate to close whether the kelly K and the body section 11*a* are rotating or not. In either event, downward movement of the support collar 90 causes the bearing rollers 91*b* of the bearings 91 to engage the lower face 60*c* of the recess 60*a* in the support ring 60 and move the support ring 60 and the actuating sleeve assembly attached thereto downwardly.

As the actuating sleeve assembly 50 is moved downwardly, the racks 71 and 81 in the side housing portions 55 and 57, respectively, of the actuating sleeve assembly 50, engage the pinions 73 and 83 causing them to rotate. Rotation of the pinions 73 and 83 rotate the shafts 74 and 84, respectively. In this manner, the pins 77 and 87, which are eccentrically positioned with respect to the axis of rotation of the shafts 74 and 84, respectively, engage the slots 16*f* and 16*g* in the valve element 16 and move the valve element to the closed position of FIG. 3.

When the valve element 16 is in the open position illustrated in FIGS. 2, 4 and 5, a portion 16*ff* of the slot 16*f* extends horizontally. Therefore, as the pin 77 is moved or rotated with the shaft 74, the pin 77 engages a wall of the slot 16*f* and rotates the valve element 16 until the slot portion 16*f* is positioned vertically. When the slot portion 16*ff* of the slot 16*f* has been moved to the vertical position, the valve element 16 is in the closed position illustrated in FIG. 3. Similarly, the pin 87 engages the slot 16*g* and rotates the valve element 16 until this portion of the slot having the pin 87 therein is vertical. Further downward movement of the actuating sleeve assembly 50, and thus further rotation of the valve element 16, is prevented by limit means 115 and 118.

Whenever it is desired to open the valve V, hydraulic fluid under pressure is supplied from the remotely located hydraulic means H through the hose L1 into the lower chamber portion 101*a* of the hydraulic cylinder 101 thereby moving the piston 103 and the rod 104 attached thereto upwardly. Upward movement of the rod 104 moves upwardly the support collar 90 and the bearings 91 mounted therein. The roller bearing portions 91*b* of the bearings 91 engage the upper surface 60*b* of the recess 60*a* in the upper support sleeve 60 thereby moving upwardly the upper support sleeve 60 and the actuating sleeve assembly 50 attached thereto.

As the actuating sleeve assembly 50 is moved upwardly, the racks 71 and 81 mounted therein engage the pinions 73 and 83 therby causing them to rotate. Rotation of the pinion 73 and 83 cause the shaft 74 and 84, respectively, to rotate thereby causing the pins 77 and 87 to engage the respective slots 16*f* and 16*g* in the valve element 16 and move the valve element to the open position of FIGS. 2, 4 and 6. With the valve element 16 once again in the open position, the opening 16*a* is aligned with the bore 11*d* of the rotating body section 11*a* such that flow through the bore 11*d* is once again unobstructed.

During emergency conditions, it is possible that the remotely located hydraulic means H could be damaged to the extent that the plurality of hydraulic cylinders 101 would not be operable. If such a condition were to exist, any hydraulic fluid under pressure in the double acting cylinder would probably be lost. As discussed previously, the plurality of coil springs such as 110 are held in a coiled position by the plurality of hydraulic cylinders such as 101 when the valve element 16 is in the open position. If pressure is lost in the hydraulic fluid in the lower chamber portion 101*a* of the hydraulic cylinder 101, the force of the plurality of compressed coil springs such as 110 is sufficient to move the support collar 90 downwardly such that the valve element 16 is rotated to the closed position. In this manner the plurality of coil springs 110 function as a secondary power supply to insure that the valve V of the preferred embodiment of this invention will be automatically closed in the event of damage to the remotely located hydraulic power means H.

The hydraulic cylinder assemblies, such as 100, need not be double acting. Single acting hydraulic cylinders may be used to close the valve element 16. Such single acting cylinder assemblies would be mounted in place of the double acting cylinders 100 (the compressed coil springs such as 110 would not be utilized) and the application of hydraulic fluid through the passageway 10*f* in the adapter 10*c* would drive the support collar 90 downwardly. Also, single acting hydraulic cylinders can be used in conjunction with the compressed coil springs. For example, such single acting cylinder assemblies would hold the coil spring 100 in the compressed state. When the pressure in the single acting hydraulic cylinder assemblies dropped sufficiently, the spring 100 would move the support collar 90 downwardly and rotate the valve element 16 to the closed position.

Any such in line safety valve such as the valve V of this invention is continually exposed to flowing drilling mud during drilling operations. Continuous exposure to drilling mud may eventually cause a valve to erode to the extent that it would be virtually ineffective when called upon to block a pressure build-up from the down-hole. Therefore, any such in line safety valves such as the valve V should be periodically tested in order to insure that the valve has not been damaged to the point that it would be ineffectual. In many of the prior art valves, it has been necessary to apply a pressurized fluid from a point below or downstream of a valve located above the kelly K to test the effectiveness of the valve against pressure from downhole.

However, in the valve V of the preferred embodiment of this invention, it is possible to determine the effectiveness of the valve V by applying pressurized fluid from above or upstream. Such upstream testing is obviously much more convenient than any type of downstream testing because, in order to test downstream, it is necessary for the operators to actually break in at some point below the kelly K and apply the pressure from downstream to test the valve. Of course, upstream testing is much easier, since it is simply a matter of running a fluid under pressure through already existing lines leading to the gooseneck G of the swivel S.

The reason that the valve V of this invention can be tested for effectiveness from above is due to the floating action of the valve element 16 in cooperation with the lower valve seat ring 24 and the upper valve seat ring 27. The valve element 16 cooperates with the lower seat ring 24 and the upper seat ring 27 to move or float longitudinally between shoulders 20 and **30*b* to provide upper and lower sealing zones. The upper sealing zone has already been defined as the sealing zone created by the sealing action of the seal ring 28 against the upper partially spherical surface 16*b* of the valve element 16. The lower sealing zone has been defined as the sealing zone created by the cooperation of the lower seal ring 25 and the lower partially spherical surface 16*c* of the valve element 16.**

With the valve element 16 in the closed position, both the upper and lower sealing zones are effective such that if the lower sealing zone were to be defective for some reason, the upper sealing zone would be sufficient to prevent flow from downhole through the bore **11*d*.**

With the valve element 16 in the closed position and with the presence of a pressure exerted downstream such as from downhole, the upper and lower sealing zones function in the following manner. The pressure exerted from downhole acts against the lower face **24*b* of the lower seat ring to act with the wavy spring 26 to urge the lower seat ring 24 upwardly. Since the valve element 16 is positioned such that portions such as 16*ff* of the slots 16*f* and 16*g* are vertical when the valve is in the closed position, the valve element is free to move or float longitudinally with respect to the lower recess 23 and thus is moved upwardly, if only slightly, under the urging of the pressurized fluid against the lower partially spherical surface 16*c* of the valve element 16. The lower seat ring 24 moves upwardly with the valve element 16 such that the seal ring 25 engages the lower partially spherical surface 16*c*** and provides the lower sealing zone.

The upward force caused by the exertion of the pressurized fluid on the lower partially spherical surface **16*c* of the valve element 16 in cooperation with the downward force exerted by wavy spring 29, causes the seat ring 28 in the upper seat ring 27 to sealingly engage with the upper partially spherical surface 16*b* thereby providing an upper sealing zone. If damage due to errosion or some other cause renders ineffective the lower sealing zone, the upper sealing zone will still block the flow from downhole through the bore 11*d*.**

The effectiveness of the upper and lower sealing zones can be tested by applying pressurized fluid from upstream or above the valve element 16. When pressure is applied from upstream, the pressurized fluid exerts a force on the upper face **27*b* of the upper seat ring 27 and upon the upper partially spherical surface 16*b* of the valve element. As mentioned previously, in the closed position the valve element 16 is free to move longitudinally due to the vertical position of portions of slots 16*f* and 16*g*; therefore, the exertion of the pressure from upstream causes the upper seat ring 27, the valve element 16 and the lower seat ring 24 to move or slide at least slightly downwardly. The exertion of the pressurized fluid from upstream causes a sealing engagement at the upper sealing zone between the upper seat ring 28 and the upper partially spherical surface 16*b*; further, the lower sealing zone is provided by the force applied against the upper partially spherical surface 16*b* such that the lower partially spherical surface 16*c* is in sealing engagement with the seal ring 25 in the lower seat ring 24, which is urged upwardly by wavy spring 26.** If for some reason the upper sealing zone is defective, the pressure test will still be good in that pressure will be held from upstream by the seal at the lower sealing zone. Therefore, if the valve prevents the passage of the test fluid from upstream, then either the upper sealing zone or the lower sealing zone or both sealing zones are operating effectively to block flow from upstream. And, such a result would indicate to the operator or user of this valve V that the valve would be effective at either the lower sealing zone or the upper sealing zone or both sealing zones to prevent the passage of flow from downstream. Thus the valve V may be easily and conveniently tested by the application of fluid from the upstream side of the valve in order to determine the effectiveness of the valve for blocking off increased downhole pressure.

The method of this invention is accomplished by the utilization of the apparatus of this invention and basically includes the steps of first mounting a valve element such as 16 below the swivel S in an oil or gas well in line with the kelly K. The valve is moved between open and closed positions by rotating the valve element 16 and, in order to operate the valve effectively and quickly, the valve element is operated from a remote location such as at another point on the well platform by the use of hydraulic power means. In this manner flow to the kelly K and drilling string (not shown) is regulated from a remote location. The apparatus and method of this invention thus removes the necessity of having an operator manually turn a valve mounted at the upper kelly K. For such manual operation of the upper kelly valves has proven to be time consuming and perhaps even dangerous if there is any danger such as fire present about the kelly K at the time that the upper kelly valve should be closed.

The foregoing disclosure and description of the invention are illustrative and explanatory thereof, and various changes in the size, shape and materials as well as in the details of the illustrated construction may be made without departing from the spirit of the invention.

What is claimed is:

1. A remotely operable valve for controlling flow of fluid through a rotating tubular member, comprising:

a stationary housing section comprising a generally tubular assembly;

a rotatable tubular housing section having a flow passage formed therein, said rotatable housing section movably mounted with said stationary housing section to enable relative circumferential rotation of said rotatable housing section with respect to said stationary housing section;

bore closure means mounted with said rotatable housing for controlling flow of fluid through said flow passage by movement of a flow controlling member to and from an open position for enabling flow of fluid through said flow passage and a closed position for blocking flow of fluid through said flow passage;

actuating means operably connecting said stationary housing section with said bore closure means for moving said flow control member to and from the open and closed position, said actuating means including;

an actuating assembly rotatable with said rotatable housing section and mounted for longitudinal movement with respect to said rotatable housing section for controlling movement of said flow controlling member, said actuating assembly having first and second shafts rotably mounted with said rotatable tubular housing section and operably engaging said flow controlling member on opposite sides of said member for effecting desired flow controlling movement of said flow controlling member when said first and second shafts are rotated, each of said shafts mounting a pivot pin in an eccentrically position with respect to the axis of rotation of said shaft for imparting operating movement to said flow controlling member when said shafts are rotated;

said actuating assembly including:

an actuating sleeve positioned about said rotatable housing section, said actuating sleeve being generally tubular and disposed concentrically outwardly of said rotatable housing section and mounted for slidable longitudinal movement with respect thereto;

gear means operably connecting said actuating sleeve with said first and second shafts for rotating said first and second shafts upon longitudinal movement of said actuating sleeve;

support means supporting actuating sleeve for rotation with said rotatable housing section and for movement longitudinally with respect thereto and being disposed concentrically outwardly of said rotatable housing section and including bearing means mounting said actuating sleeve for rotation with said rotatable housing section wherein said actuating sleeve is movable longitudinally with respect to said rotatable housing section and rotates therewith so that said gear means moves said flow controlling member between said open and said closed positions;

operating means disposed between said stationary housing section and said support means and operably connecting said stationary housing section and said actuating assembly for operably moving said actuating sleeve longitudinally with respect to said rotatable housing section to rotate said first and said second shafts to move said bore closure means to the open and closed positions while enabling relative circumferential rotation between said operating means and said actuating assembly, said operating means including primary power means operable from a point remote from said valve for moving said actuating assembly to effect movement of said flow controlling member to and from the open and closed position and secondary power means for moving said actuating assembly to effect movement of said flow controlling member to the closed position when said primary power means fails;

said actuating sleeve including an elongated slot therein; and a disc element mounted on said rotating housing section and extending into said slot wherein longitudinal movement of said actuating sleeve with respect to said rotating housing is limited.

* * * * *